US010020095B1

(12) United States Patent
Huang et al.

(10) Patent No.: US 10,020,095 B1
(45) Date of Patent: Jul. 10, 2018

(54) COAXIAL CABLE

(71) Applicant: Hitachi Metals, Ltd., Tokyo (JP)

(72) Inventors: Detian Huang, Tokyo (JP); Masanori Kobayashi, Tokyo (JP); Kazuhiro Aida, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/839,470

(22) Filed: Dec. 12, 2017

(30) Foreign Application Priority Data

Mar. 3, 2017 (JP) ..... 2017-040551

(51) Int. Cl.

| | |
|---|---|
| ***H01B 11/18*** | (2006.01) |
| ***H01B 1/02*** | (2006.01) |
| *H01R 13/6592* | (2011.01) |
| *H01R 103/00* | (2006.01) |

(52) U.S. Cl.
CPC ..... *H01B 11/1834* (2013.01); *H01B 1/023* (2013.01); *H01B 11/1808* (2013.01); *H01B 11/1878* (2013.01); *H01R 13/6592* (2013.01); *H01R 2103/00* (2013.01)

(58) Field of Classification Search
CPC ..... H01B 11/1834; H01B 11/1878; H01B 7/0208; H01B 7/0225
See application file for complete search history.

(56) References Cited

U.S. PATENT DOCUMENTS

| | | | | |
|---|---|---|---|---|
| 6,037,545 A * | 3/2000 | Fox | ..... | H01B 11/1826 174/110 F |
| 6,756,538 B1 * | 6/2004 | Murga-Gonzalez | ..... | H01B 11/1839 174/102 R |
| 2017/0062096 A1 * | 3/2017 | Koeppendoerfer | .... | H01B 3/308 |

FOREIGN PATENT DOCUMENTS

| | | | |
|---|---|---|---|
| JP | 60183312 | U | 12/1985 |
| JP | 2005-025999 | A | 1/2005 |
| JP | 2010113835 | A | 5/2010 |
| JP | 201154398 | A | 3/2011 |
| JP | 2012216456 | A | 11/2012 |

OTHER PUBLICATIONS

Office Action issued in the corresponding Japanese Application No. 2017-040551 dated Mar. 20, 2018, 5 pages.

* cited by examiner

*Primary Examiner* — Hoa C Nguyen
*Assistant Examiner* — Amol Patel
(74) *Attorney, Agent, or Firm* — Roberts Mlotkowski Safran Cole & Calderon P.C.

(57) ABSTRACT

A coaxial cable includes a conductor, an insulation layer provided around the conductor, a shield layer provided around the insulation layer, and a sheath provided around the shield layer. The insulation layer includes a first insulation layer, a second insulation layer and a third insulation layer that are arranged in this order from a conductor side. The first insulation layer includes a non-solid extruded layer. The second layer includes a foamed layer not adhering to the first insulation layer. The third insulation layer includes a non-foamed layer adhering to the second insulation layer.

5 Claims, 2 Drawing Sheets

COAXIAL CABLE

The present application is based on Japanese patent application No. 2017-040551 filed on Mar. 3, 2017, the entire contents of which are incorporated herein by reference.

BACKGROUND OF THE INVENTION

1. Field of the Invention

The invention relates to a coaxial cable.

2. Description of the Related Art

In some of industrial robots (working machines) used in production lines involving automotive welding or parts assembly, etc., coaxial cables are used for signal transmission from camera sensors and such coaxial cables are wired in moving parts and repeatedly bent and twisted. Some of such coaxial cable wired in moving parts are provided with, e.g., an inner conductor, an insulation layer surrounding the inner conductor, an outer conductor (shield layer) surrounding the insulation layer and a sheath surrounding the outer conductor, and are configured that the insulation layer is an integrally-extruded structure of polytetrafluoroethylene (PTFE) which is a low-dielectric constant resin (e.g., JP 2005/025999A).

SUMMARY OF THE INVENTION

In recent years, coaxial cables used in production lines and wired in moving parts are required to perform long-distance transmission. In this case, foamed coaxial cables having a foamed insulation as an insulation layer could be used for the purpose of reducing transmission loss in coaxial cable. However, the foamed coaxial cables have a problem that the foamed insulation layer has a low mechanical strength and may crack when repeatedly subjected to bending or twisting.

It is an object of the invention to provide a coaxial cable that allows improvement in flex resistance and twist resistance while maintaining electrical characteristics.

According to an embodiment of the invention, a coaxial cable comprises:

a conductor;

an insulation layer provided around the conductor;

a shield layer provided around the insulation layer; and a sheath provided around the shield layer, wherein the insulation layer comprises a first insulation layer, a second insulation layer and a third insulation layer that are arranged in this order from a conductor side, wherein the first insulation layer comprises a non-solid extruded layer, wherein the second layer comprises a foamed layer not adhering to the first insulation layer, and wherein the third insulation layer comprises a non-foamed layer adhering to the second insulation layer.

Effects of the Invention

According to an embodiment of the invention, a coaxial cable can be provided that allows improvement in flex resistance and twist resistance while maintaining electrical characteristics.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Embodiment of the Invention

A coaxial cable in an embodiment of the invention will be described below in reference to the drawings.

(1) Use Position of Coaxial Cable

Firstly, the use position of the coaxial cable in the present embodiment will be briefly described with a specific example.

The coaxial cable in the present embodiment is used for, e.g., signal transmission from a camera sensor of an industrial robot (working machine) or equivalent automation equipment used in production line involving automotive welding or parts assembly, etc. Coaxial cables used in such position can have various lengths, from 5 m to 50 m, depending on a structure of industrial robot, etc., or length of production line. Thus, coaxial cables are required to have excellent electrical characteristics allowing for reliable signal transmission as well as long-distance signal transmission. In details, coaxial cables are required to have a low capacitance and a high characteristic impedance and to cause only small signal attenuation.

Meanwhile, a camera sensor is sometimes arranged in a moving part of industrial robot, etc. Therefore, coaxial cables are required to be suitable for wiring in moving parts, i.e., are required to have an enhanced life (high flex/twist resistance) such as withstanding, e.g., not less than 300,000 cycles of repeated bends or twists (e.g., bend with a bend radius which is about three times the outer diameter of the coaxial cable, or twist with a twist length which is about twenty times the cable outer diameter).

In other words, the coaxial cable of the present embodiment needs to have a combination of electrical characteristics suitable for long-distance transmission and flex-and-twist resistance. To meet such requirement, the coaxial cable of the present embodiment is configured as follows.

(2) General Configuration of the Coaxial Cable

Figure 1:
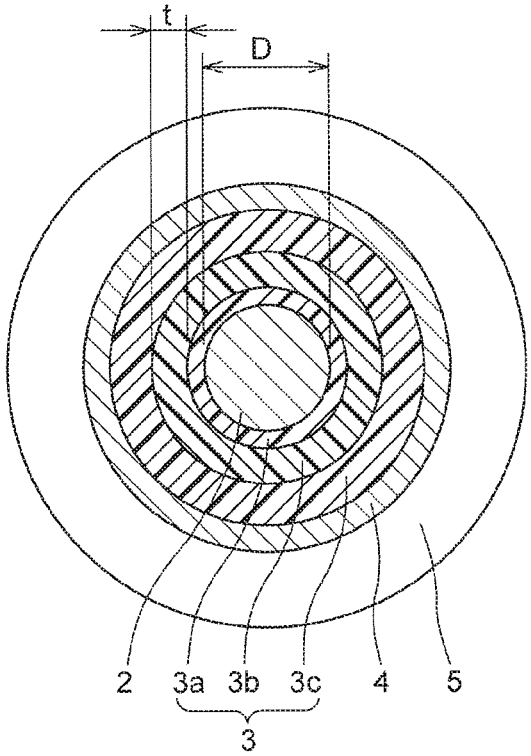
FIG. 1 is a schematic cross sectional view showing a configuration example of a coaxial cable in an embodiment of the present invention.
Figure 2:
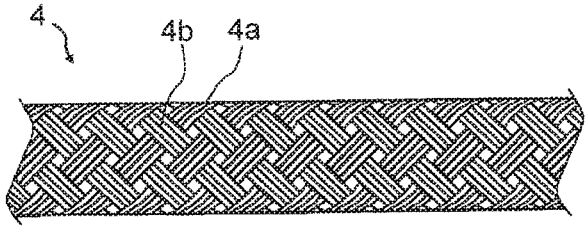
FIG. 2 is a schematic diagram illustrating a configuration example of a shield layer of the coaxial cable in the embodiment of the invention.

FIG. 1 is a schematic cross sectional view showing a configuration example of a coaxial cable in the present embodiment. FIG. 2 is a schematic explanatory diagram illustrating a configuration example of a shield layer of the coaxial cable in the present embodiment.

Overall Structure

As shown in FIG. 1, a coaxial cable 1 described as an example in the present embodiment is generally provided with a conductor 2, an insulation layer 3 provided around the conductor 2, a shield layer 4 provided around the insulation layer 3, and a sheath 5 provided around the shield layer 4.

Conductor

The conductor 2 used here is, e.g., a bunch-stranded conductor formed by twisting plural copper wires or copper alloy strands. In detail, a bunch-stranded conductor which is composed of strands each having a diameter of 0.05 mm to 0.08 mm and has an elongation of not less than 5% and a tensile strength of not less than 330 MPa is used so as to allow for long-distance signal transmission and also to have flex resistance and twist resistance. In detail, such strand is formed of, e.g., Sn-0.7 Cu-0.3 (mass %) or Sn-0.6 Cu-0.2 In-0.2 (mass %), etc.

Meanwhile, a twist pitch of the conductor 2 is preferably not less than 10 times and not more than 14 times the outer diameter of the conductor 2. When the twist pitch is less than 10 times the outer diameter, flex resistance is improved but twist resistance decreases. When the twist pitch is more than 14 times the outer diameter, twist resistance is improved but flex resistance decreases. Flex resistance and twist resistance can be both achieved by adjusting the twist pitch of the conductor 2 to be not less than 10 times and not more than 14 times its outer diameter.

Insulation Layer

The insulation layer 3 is a layer which is formed of an insulating resin material and surrounds the conductor 2.

In the present embodiment, the insulation layer 3 is composed of three layers; a first insulation layer 3*a*, a second insulation layer 3*b* and a third insulation layer 3*c* which are arranged in this order from the conductor 2 side.

The details of the first insulation layer 3*a*, the second insulation layer 3*b* and the third insulation layer 3*c* will be described later.

Shield Layer

The shield layer 4 is a layer for preventing leakage of transmission signal or for shielding external noise, and has, e.g., a shield structure. That is, the shield layer 4 is formed of, e.g., a braided shield formed by braiding tinsel copper wires or metal wires formed of copper or a copper alloy. It is particularly preferable that the shield layer 4 be formed of a braided shield formed by braiding tinsel copper wires 4*a* and metal strands 4*b* of a copper alloy in a crisscross manner, as shown in FIG. 2.

Sheath

The sheath 5 in FIG. 1 is a layer to be an outer cover which is the outermost layer of the coaxial cable 1. The material used to form the sheath 5 is, e.g., a polyvinyl chloride (PVC) resin or a polyurethane (PU) resin, etc., so that the coaxial cable 1 can be protected from an external force.

(3) Essential Configuration of the Coaxial Cable

Next, the first insulation layer 3*a*, the second insulation layer 3*b* and the third insulation layer 3*c* which constitute the insulation layer 3 will be described as an essential configuration of the coaxial cable 1 in the present embodiment.

First Insulation Layer

The first insulation layer 3*a* is formed of a low-dielectric constant non-foamed resin material by tubing extrusion and provided around the conductor 2 formed of a bunch-stranded conductor. When the first insulation layer 3*a* is formed by tubing extrusion, the resin material constituting the insulation layer 3 does not fill up boundary spaces between the strands constituting the conductor 2 (the first insulation layer 3*a* is non-solid), and a gap is thus partially formed between the conductor 2 and the first insulation layer 3*a*.

When the coaxial cable 1 is bent, a tensile force (elongation) applied to the first insulation layer 3*a* is larger than that applied to the conductor 2. However, since between the conductor 2 and the first insulation layer 3*a* is not completely filled, the conductor 2 can move independently from the first insulation layer 3*a* and is less likely to receive the tensile force through the first insulation layer 3*a*, which improves flex resistance and twist resistance.

The material used to form the first insulation layer 3*a* is, e.g., tetrafluoroethylene-hexafluoropropylene (FEP) copolymer ($\in$=2.1) or tetrafluoroethylene-perfluoroalkyl vinyl ether (PFA) copolymer ($\in$=2.1), etc.

Second Insulation Layer

The second insulation layer 3*b* is formed of a foamed insulating resin material having a degree of foaming of not less than 30% and not more than 50% and thus having a lower dielectric constant so that the coaxial cable 1 can secure excellent electrical characteristics. In addition, the resin material used to form the second insulation layer 3*b* has a lower melting point than the resin material used to form the first insulation layer 3*a*, and the second insulation layer 3*b* does not adhere to the first insulation layer 3*a*.

When the coaxial cable 1 is bent, a tensile force applied to the second insulation layer 3*b* is larger than that applied to the first insulation layer 3*a*. However, since the second insulation layer 3*b* does not adhere to the first insulation layer 3*a*, the first insulation layer 3*a* can move independently from the second insulation layer 3*b* and is less likely to receive the tensile force through the second insulation layer 3*b*, which improves flex resistance and twist resistance of the coaxial cable 1.

Third Insulation Layer

The third insulation layer 3*c* is provided to add strength so that the second insulation layer 3*b* formed of a foamed insulating resin is prevented from being damaged, e.g., broken, due to strain generated when the coaxial cable 1 is bent or twisted. The third insulation layer 3*c* is formed of the same resin material as the second insulation layer 3*b* by fully solid extrusion so as to fill the air bubble holes appeared on the surface of the second insulation layer 3*b* and adds strength by being integrated with (adhered to) the second insulation layer 3*b*. The third insulation layer 3*c* is preferably formed of, e.g., a non-foamed insulating resin layer providing an elongation of not less than 300%, a tensile strength of not less than 25 MPa and a dielectric constant of 2.5.

When the third insulation layer 3*c* located on the outer side has larger tensile strength and elongation than the second insulation layer 3*b* as described above, the insulation layer 3 has such a configuration that mechanical strength and elongation increase toward the outside and the insulation layer 3 is thus less likely to crack even when the coaxial cable 1 is repeatedly bent or twisted. In other words, elongation and flexibility, etc., of the insulation layer 3 can be sufficiently maintained by having mechanical strength and elongation which increase toward the outside, and this improves flex resistance and twist resistance of the coaxial cable 1.

The combination of the material used to form the second insulation layer 3*b* and the material used to form the third insulation layer 3*c* is, e.g., a combination of expanded polypropylene and non-expanded polypropylene, or a combination of radiation cross-linked foamed polyethylene and radiation cross-linked polyethylene.

Insulation Layer with the Three-Layer Structure

As described above, the insulation layer 3 has a three-layer structure composed of the first insulation layer 3*a*, the second insulation layer 3*b* and the third insulation layer 3*c*. Thus, the insulation layer 3 can satisfy both electrical characteristics and a flex resistance that are conflicting properties. In other words, it is possible to improve flex resistance and twist resistance while maintaining excellent electrical characteristics.

When the coaxial cable 1 is bent, a tensile force applied to the third insulation layer 3*c* is larger than that applied to the first and second insulation layers 3*a* and 3*b*. Even in such a case, it is possible to prevent cracks on the third insulation layer 3*c*, i.e., on the outer layer of the insulation layer 3 since the third insulation layer 3*c* is formed of a material having a high tensile strength and a high elongation.

The third insulation layer 3*c* is formed of a material having a high tensile strength and a high elongation and is thus less likely to crack. Even if cracks occur on the third insulation layer 3*c* by any chance, the cracks occur only on the third insulation layer 3*c* and are stopped since the insulation layer 3 has a three-layer structure composed of the first insulation layer 3*a*, the second insulation layer 3*b* and the third insulation layer 3*c*. In other words, the second insulation layer 3*b* acts as a crack stopper and can prevent cracks from occurring in the entire insulation layer 3, resulting in that it is possible to realize a long life of the coaxial cable 1 against repeated bends or twists.

Size of the First Insulation Layer

In the insulation layer 3 having a three-layer structure, the thickness of the first insulation layer 3*a* is preferably not less than 0.2 times and not more than 0.3 times an outer diameter D of the conductor 2.

When the thickness of the first insulation layer 3*a* is less than 0.2 times the conductor diameter D, the first insulation layer 3*a* is too thin and may crack due to low strength when the coaxial cable 1 is bent. The first insulation layer 3*a* having a thickness which is not less than 0.2 times the conductor diameter D can have sufficient strength.

On the other hand, when the thickness of the first insulation layer 3*a* is more than 0.3 times the conductor diameter D, the first insulation layer 3*a* is too thick and thus too hard and may crack due to poor flexibility when the coaxial cable 1 is bent. The first insulation layer 3*a* having a thickness which is not more than 0.3 times the conductor diameter D can have flexibility.

Size of the Second Insulation Layer

In the insulation layer 3 having a three-layer structure, the thickness of the second insulation layer 3*b* depends on the diameter of the conductor 2 and is unambiguously determined so that the coaxial cable 1 has a predetermined characteristic impedance (50Ω or 75Ω, etc.).

Size of the Third Insulation Layer

In the insulation layer 3 having a three-layer structure, the thickness of the third insulation layer 3*c* is preferably not less than 1 time and not more than 1.5 times the thickness of the second insulation layer 3*b*.

When the thickness of the third insulation layer 3*c* is less than equal to the thickness t of the second insulation layer 3*b*, the third insulation layer 3*c* is too thin to exert an effect of reinforcing the second insulation layer 3*b*, which may lead to a decrease in flex resistance. However, it is possible to prevent a decrease in flex resistance when the thickness of the third insulation layer 3*c* is not less than equal to the thickness t of the second insulation layer 3*b*.

On the other hand, when the thickness of the third insulation layer 3*c* is more than 1.5 times the thickness of the second insulation layer 3*b*, the third insulation layer 3*c* is too thick and this may lead to a decrease in electrical characteristics. However, it is possible to maintain good electrical characteristics when the thickness of the third insulation layer 3*c* is not more than 1.5 times the thickness of the second insulation layer 3*b*.

Braided Shield

The shield layer 4 is preferably a braided shield formed by spirally winding the tinsel copper wires 4*a* in one direction (e.g., clockwise) and the metal strands 4*b* in the opposite direction (e.g., counterclockwise) so that the tinsel copper wires 4*a* and the metal strands 4*b* are braided in a crisscross manner.

The tinsel copper wire 4*a* is formed by wrapping copper foil around a core string formed of polyester, etc., and has better flex resistance or twist resistance but higher conductor resistance than the metal strand 4*b*. Based on this fact, the braided shield is formed using the tinsel copper wires 4*a* and the metal strands 4*b*, thereby allowing conductor resistance of the shield layer 4 to be reduced while improving flex resistance and twist resistance of the coaxial cable 1. Therefore, even when the coaxial cable 1 is long, the coaxial cable 1 can have improved flex resistance and twist resistance while satisfying the standard of round-trip DC resistance.

In addition, the tinsel copper wire 4*a* is softer than the metal strand 4*b*. Since the tinsel copper wires 4*a* and the metal strands 4*b* intersect, the tinsel copper wire 4*a* serve as cushion for the metal strands 4*b* at intersections when the coaxial cable 1 is bent or twisted and kink of the metal strands 4*b* can be thereby prevented. This improves flex resistance and twist resistance of the coaxial cable 1. Furthermore, the tinsel copper wire 4*a* is preferably thicker than the metal strand 4*b*. In this case, a stress applied to the coaxial cable 1 acts through the tinsel copper wires 4*a* having excellent bendability or flexibility, and flex resistance and twist resistance of the coaxial cable 1 can be thereby improved.

(4) Effects of the Present Embodiment

One or more effects described below are obtained in the present embodiment.

(a) In the present embodiment, the insulation layer 3 has a three-layer structure composed of the first insulation layer 3*a*, the second insulation layer 3*b* and the third insulation layer 3*c*, where the first insulation layer 3*a* is formed by tubing extrusion, the second insulation layer 3*b* is formed by foaming a low-dielectric constant resin material and the third insulation layer 3*c* is formed of the same resin as the second insulation layer 3*b* but without foaming. This allows the insulation layer 3 to satisfy both electrical characteristics and a flex resistance that are conflicting properties. Therefore, in the present embodiment, the coaxial cable 1 can exert improved flex resistance and twist resistance while maintaining excellent electrical characteristics, even when the coaxial cable 1 is used under repeated bends or twists.

(b) In the present embodiment, the inner insulation layer 3*a*, which is an insulation in contact with the conductor 2, is formed of a material having a dielectric constant $\in$ of not more than 2.3. Such dielectric constant allows the coaxial cable 1 to reliably maintain excellent electrical characteristics.

(c) In the present embodiment, the third insulation layer 3*c* located on the outermost side of the insulation layer 3 is formed of a material having an elongation of not less than 300% and a tensile strength of not less than 25 MPa. Due to such tensile strength, mechanical strength and elongation of the insulation layer 3 increase toward the outside and the insulation layer 3 can sufficiently maintain elongation and flexibility, etc., and this improves flex resistance and twist resistance of the coaxial cable 1.

(d) In the present embodiment, since the first insulation layer 3*a* has a thickness which is not less than 0.2 times and not more than 0.3 times the diameter D of the conductor, it is possible to prevent a decrease in flex resistance and twist resistance while eliminating a risk of causing a decrease in electrical characteristics. In other words, it is very suitable to improve flex resistance and twist resistance of the coaxial cable 1 while maintaining excellent electrical characteristics.

(e) In the present embodiment, since the third insulation layer 3*c* has a thickness which is not less than 1 time and not more than 1.5 times the thickness of the second insulation layer 3*b*, it is possible to maintain excellent electrical characteristics while eliminating a risk of causing a decrease in flex resistance and twist resistance. In other words, it is very suitable to improve flex resistance and twist resistance of the coaxial cable 1 while maintaining excellent electrical characteristics.

Other Embodiments of the Invention

Although the embodiment of the invention has been specifically described above, the technical scope of the invention is not to be limited to the embodiment and can be appropriately changed without departing from the gist thereof.

For example, although the example in which the coaxial cable 1 is used for signal transmission from a camera sensor of an industrial robot (working machine) or equivalent automation equipment has been described in the embodiment, the invention is not limited thereto. That is, the invention is very effective when applied to coaxial cables wired in small spaces and repeatedly subjected to bending or twisting in a machine with a high operating rate, and is applicable to cables used for other purposes than signal transmission from the camera sensor.

EXAMPLE

Next, Example of the invention will be specifically described. However, the invention is not limited to the following Example.

In this Example, the conductor 2 formed of a 50/0.08 mm bunch-stranded conductor (twist pitch: about 8 mm) having a size equivalent to 24 AWG (American Wire Gauge) was covered with a 0.15 mm-thick first insulation layer 3*a* formed of FEP with a dielectric constant $\in$=2.1 by tubing extrusion, the first insulation layer 3*a* was then covered with a 0.5 mm-thick second insulation layer 3*b* formed of foamed PP having a degree of foaming of 40%, and the second insulation layer 3*b* was further covered with a 0.65 mm-thick third insulation layer 3*c* formed of PP (non-foamed) with a dielectric constant $\in$=2.26, thereby obtaining the insulation layer 3 having an outer diameter of 3.3 mm. Then, the insulation layer 3 was covered with the braided shield layer 4 formed by braiding tinsel copper wires having an outer diameter of 0.11 mm and metal strands having an outer diameter of 0.08 mm in a crisscross manner, and a 1.3 mm-thick sheath 5 was provided therearound, thereby obtaining the coaxial cable 1 having an outer diameter of 6.5 mm. The metal strands constituting the conductor 2 and the metal strands constituting the braided shield layer 4 were formed of an alloy of Sn-0.7 Cu-0.3 (mass %).

Bend Test

A bend test was conducted on the coaxial cable 1 having the above-described configuration.

Figure 3:
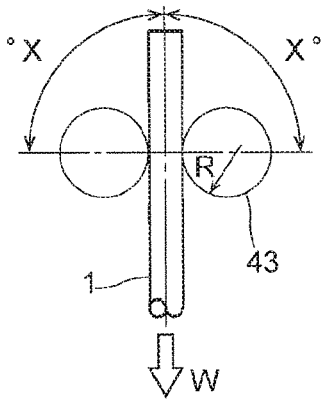
FIG. 3 is a conceptual diagram illustrating a bend test.

The bend test was conducted as follows: as shown in FIG. 3, a weight to apply a load W=5N (500 gf) was suspended from a lower end of the coaxial cable 1 as a sample, bending jigs 43 having a curved shape were attached to the right and left sides of the coaxial cable 1, and the coaxial cable 1 was then moved right and left along the bending jigs 43 at a bending angle X of ±90°. The bend R (bend radius) was 19 mm which is about three times the outer diameter of the coaxial cable 1. The bending rate was 30 cycles per minute. For the number of bends, moving right and left once was counted as one bending cycle. During when the coaxial cable 1 was repeatedly bent, conduction of the inner conductor between two ends of the cable was checked after every appropriate cycles, and the number of bends at which conduction was lost was recorded as a flex life.

As a result of the bend test, it was confirmed that the conductor 2 and the braided shield layer 4 of the coaxial cable 1 in Example were not broken even after 600,000 bending cycles which is a standard requirement for coaxial cables.

Twist Test

A twist test was conducted on the coaxial cable 1 having the above-described configuration.

Figure 4:
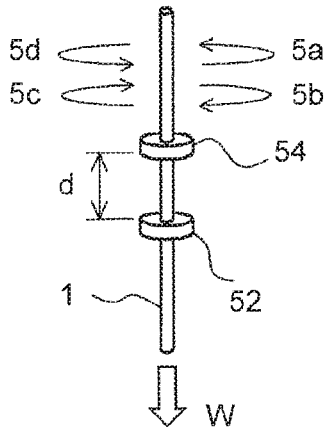
FIG. 4 is a conceptual diagram illustrating a twist test.

The twist was conducted as follows: as shown in FIG. 4, a fixed chuck 52 as a non-rotatable member was attached to a portion of the coaxial cable 1 as a sample and a rotating chuck 54 was attached to a portion above the fixed chuck 52 with a distance (twist length) d=130 mm which is about twenty times the outer diameter of the coaxial cable 1. Then, a weight to apply a load W=5N (500 gf) was suspended from a lower end of the coaxial cable 1. The rotating chuck 54 was rotated in this state to apply twists of ±180° to the portion of the coaxial cable 1 between the fixed chuck 52 and the rotating chuck 54. The rotating chuck 54 was firstly rotated +180°, returned to the starting position, then rotated −180° and returned to the starting position, i.e., moved in directions of arrows 5*a*, 5*b*, 5*c* and 5*d* in this order. This complete movement was defined as one cycle (one twist). The twisting rate was 30 cycles per minute. For the number of twists, moving in two directions once was counted as one twist. During when the coaxial cable 1 was repeatedly twisted, conduction of the inner conductor between two ends of the cable was checked after every appropriate cycles, and the number of twists at which conduction was lost was recorded as a twist life.

As a result of the twist test, it was confirmed that the conductor 2 and the braided shield layer 4 of the coaxial cable 1 in Example were not broken even after 2,400,000 twisting cycles which is a standard requirement for coaxial cables.

What is claimed is:

1. A coaxial cable, comprising:

a conductor;

an insulation layer provided around the conductor;

a shield layer provided around the insulation layer; and a sheath provided around the shield layer, wherein the insulation layer comprises a first insulation layer, a second insulation layer and a third insulation layer that are arranged in this order from a conductor side, wherein the first insulation layer comprises a non-solid extruded layer, wherein the second layer comprises a foamed layer not adhering to the first insulation layer, and wherein the third insulation layer comprises a non-foamed layer adhering to the second insulation layer.

2. The coaxial cable according to claim 1, wherein a thickness of the first insulation layer is not more than 0.2 times and not more than 0.3 times a diameter of the conductor.

3. The coaxial cable according to claim 1, wherein a thickness of the third insulation layer is not less than 1 time and not more than 1.5 times a thickness of the second insulation layer.

4. The coaxial cable according to claim 1, wherein the shield layer comprises a braided shield formed by braiding tinsel copper wires and metal strands in a crisscross manner.

5. A coaxial cable, comprising:

a conductor;

an insulation layer provided around the conductor;

a shield layer provided around the insulation layer; and a sheath provided around the shield layer, wherein the insulation layer comprises a first insulation layer, a second insulation layer and a third insulation layer arranged in this order from a conductor side, wherein the first insulation layer comprises a non-foamed layer not adhering to the conductor, wherein the second layer comprises a foamed layer not adhering to the first insulation layer, and wherein the third insulation layer comprises a non-foamed layer adhering to the second insulation layer.

* * * * *